US008307995B2

(12) United States Patent
Surma et al.

(10) Patent No.: US 8,307,995 B2
(45) Date of Patent: Nov. 13, 2012

(54) THEFT DETERRENT SYSTEM

(75) Inventors: Terrance Surma, Carol Stream, IL (US); Roger J. Leyden, Franklin Park, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 521 days.

(21) Appl. No.: 12/476,346

(22) Filed: Jun. 2, 2009

(65) Prior Publication Data

US 2010/0300992 A1 Dec. 2, 2010

(51) Int. Cl.
*E05B 73/00* (2006.01)

(52) U.S. Cl. ..... 211/7; 211/59.1; 70/57.1; 70/413

(58) Field of Classification Search ..... 211/7, 54.1, 211/85.1, 85.2, 85.3, 57.1, 59.1; 248/220.21, 248/220.31–220.43; 70/405, 413, 345, 57.1, 70/276

See application file for complete search history.

(56) References Cited

U.S. PATENT DOCUMENTS 3,444,711 A * 5/1969 Sedley ..... 70/276
3,518,855 A * 7/1970 Wake ..... 70/276
4,026,134 A * 5/1977 Woolfson ..... 70/276
4,133,194 A * 1/1979 Sedley et al. ..... 70/222
4,823,964 A * 4/1989 Lundberg ..... 211/57.1
4,869,376 A * 9/1989 Valiulis et al. ..... 211/59.1
5,027,622 A * 7/1991 Hatch et al. ..... 70/14
5,193,371 A * 3/1993 Yamane ..... 70/276
5,676,258 A 10/1997 Leyden et al.
6,659,291 B2 * 12/2003 Huehner et al. ..... 211/4
7,007,810 B2 * 3/2006 Huehner et al. ..... 211/57.1
7,131,542 B2 * 11/2006 Sedon et al. ..... 211/59.1
7,178,678 B2 * 2/2007 Mansfield et al. ..... 211/7
2001/0013567 A1 * 8/2001 Valiulis ..... 248/220.41
2003/0029816 A1 * 2/2003 Huehner et al. ..... 211/7
2004/0026344 A1 * 2/2004 Sedon et al. ..... 211/7
2005/0029205 A1 * 2/2005 Mansfield et al. ..... 211/7
2006/0157431 A1 * 7/2006 Nagelski et al. ..... 211/54.1
2006/0261016 A1 * 11/2006 Magid ..... 211/57.1
2007/0062890 A1 * 3/2007 Nagelski et al. ..... 211/57.1
2007/0119796 A1 * 5/2007 Barkdoll ..... 211/54.1
2007/0289344 A1 * 12/2007 Fawcett et al. ..... 70/58
2008/0168811 A1 * 7/2008 Nagelski ..... 70/276
2008/0169250 A1 * 7/2008 Nagelski ..... 211/7
2008/0203253 A1 * 8/2008 Vogler ..... 248/220.31
2008/0209960 A1 * 9/2008 Nagelski ..... 70/57.1
2009/0057244 A1 * 3/2009 Conti et al. ..... 211/7

* cited by examiner

*Primary Examiner* — Darnell Jayne
*Assistant Examiner* — Patrick Hawn
(74) *Attorney, Agent, or Firm* — Richard D. Harris

(57) ABSTRACT

Described herein is technology for, among other things, a theft deterrent apparatus for cooperation with an elongate member attached to and extending outwardly from a forward-facing side of an article display panel. The apparatus includes a housing defining an internal chamber. The housing includes a first aperture passing through the housing into the internal chamber for receiving the elongate member, a second aperture for receiving a magnetic key, and a locking member that has a magnetic portion and is movably disposed within the internal chamber. The locking member is adapted to selectively: maintain the apparatus in locked and unlocked configurations in which the locking member respectively prevents or permits the elongate member from being at least partially withdrawn from the first aperture. Whether the locking member maintains the apparatus in the locked or unlocked configuration depends on whether or not the magnetic key is inserted into the second aperture.

31 Claims, 11 Drawing Sheets

THEFT DETERRENT SYSTEM

BACKGROUND

1. Field

Embodiments of the present invention generally relate to theft deterrent systems as used to prevent unauthorized removal of consumer goods.

2. Background

Those involved in the distribution of consumer goods are constantly seeking ways to prevent unauthorized removal of goods from display areas. The expense of security systems and personnel used to limit losses due to theft is generally recovered by raising the price of the goods to the consumer. In today's highly competitive market, the successful retailer thus seeks security systems that are both economically practical and effective.

Electronic theft deterrent systems have proven to be highly successful over the years. However, the use of an electronic security system is not always feasible. Sometimes, the cost of the goods to be monitored does not justify the investment in such a system. For other types of goods, such as belts, the quantity of goods displayed is such that it would be impractical to monitor each item, as by the use of a sensor thereon.

Further, highly portable goods such as belts, small hand tools, eyeglasses and sunglasses, USB flash drives, camera memory cards and printer ink cartridges, which are small, lightweight and often relatively expensive, can be easily removed from a premise before the breach of security is detected, even when electronic systems are used. Many stores are set up with display stands for such goods in close proximity to an exit door. The thief is often able to remove the article, exit promptly from the store through the adjacent exit, and become lost in crowds as are common in metropolitan areas and shopping malls.

It is known to confine a quantity of discrete articles in bulk upon a display stand. However, when this type of system is used for relatively small, lightweight articles, the thief may be able to remove and make off with the entire quantity of articles, together with the display stand.

As a result of the above problems, many purveyors of small, discrete objects, such as hand tools in hardware stores, belts and sunglasses in apparel stores, rackets and the like in sporting goods stores, USB flash drives and the like in electronics stores, etc. choose to hang this type of good unsecured on a mounting wall. In many stores, pegboard is used in conjunction with a projecting arm to support a stack of such goods. For example, a number of printer cartridges are commonly seen in computer stores supported from a cantilevered arm on a vertical wall. In the case, of eyeglasses and sunglasses, such goods are often loosely displayed in either a rotating carousel or a wallmount display. In spite of the risk associated with these types of displays, many purveyors of goods such as the aforementioned have chosen to assume this risk rather than contend with the above problems.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

Described herein is technology for, among other things, a theft deterrent apparatus for cooperation with an elongate member attached to and extending outwardly from a forward-facing side of an article display panel. The apparatus includes a housing defining an internal chamber. The housing includes a first aperture passing through the housing into the internal chamber for receiving the elongate member, a second aperture for receiving a magnetic key, and a locking member that has a magnetic portion and is movably disposed within the internal chamber. The locking member is adapted to selectively maintain the apparatus in locked and unlocked configurations in which the locking member respectively prevents or permits the elongate member from being at least partially withdrawn from the first aperture. Whether the locking member maintains the apparatus in the locked or unlocked configuration depends on whether or not the magnetic key is inserted into the second aperture.

Another embodiment of the present invention is directed to a theft deterrent system for deterring theft of an apertured article and for attachment to a forward-facing side of a display panel. The theft deterrent system includes an upper elongate member that has an attachment end and an operating end, where the attachment end is attached to the forward-facing side of the display panel. The system also includes a lower elongate member for supporting the apertured article and having an attachment end and an operating end, where the attachment end is also attached to the forward-facing side of the display panel. The system also includes a magnetic key and a locking apparatus for selectively securing the article to the lower elongate member. The locking apparatus includes a housing defining an internal chamber and including a first aperture passing through the housing into the internal chamber for receiving the upper elongate member, and a second aperture adapted to receive the magnetic key. The locking apparatus also includes an engagement member extending outwardly from the main body engaging the lower elongate member and a locking member having a magnetic portion and movably disposed within the internal chamber. The locking member is adapted to selectively maintain the theft deterrent system in either a locked configuration or an unlocked configuration, depending on whether the magnetic key is inserted (unlocked) into the third aperture or not (locked). In the locked configuration, the locking member prevents longitudinal movement of the upper elongate member within the locking apparatus, and the engagement member and the lower elongate member cooperate to prevent the article from being removed from the lower elongate member. In the unlocked configuration, the locking member permits a degree of longitudinal movement of the upper elongate member within the locking apparatus such that the lower elongate member becomes disengaged from the engagement member to permit removal of the article from the lower elongate member. The lock apparatus also includes a magnetic shield disposed between the outer surface of the housing and the magnetic key when inserted into the second aperture. The magnetic shield substantially prevents a magnetic force that is external to the housing from interacting with the locking member.

Another embodiment of the present invention is directed to a theft deterrent system for mounting to a side of a display panel and for deterring the theft of an article. The theft deterrent system includes a rigid article securement member that includes a first elongate member, a second elongate member and a connecting member connecting the first elongate member with the second elongate member, where the first and second elongate members are generally parallel to each other. The theft deterrent system also includes a locking apparatus that is adapted to be mounted to the rear-facing side of the display panel. The locking apparatus includes a housing defining an internal chamber and including a first aperture passing from an outer surface of the housing into the internal chamber and adapted to receive the first elongate member, a second aperture adapted to receive the second elongate member, and a third aperture adapted to receive a magnetic key. The locking apparatus also includes a locking member having a magnetic portion and movably disposed within the internal chamber. The locking member is adapted to selectively maintain the theft deterrent system in either a locked configuration or an unlocked configuration, depending on whether the magnetic key is inserted (unlocked) into the third aperture or not (locked). In the locked configuration, the locking member prevents the article securement member from being withdrawn from at least one of the first and second apertures, and the article securement member and the locking apparatus cooperate to secure the article to the display panel, when the magnetic key is not inserted into the second aperture. In the unlocked configuration, the locking member permits the first elongate member to be at least partially withdrawn from the first aperture and the second elongate member to be fully withdrawn from the second aperture to allow removal of the article from the display panel.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail as not to unnecessarily obscure aspects of the present invention.

Figure 1:
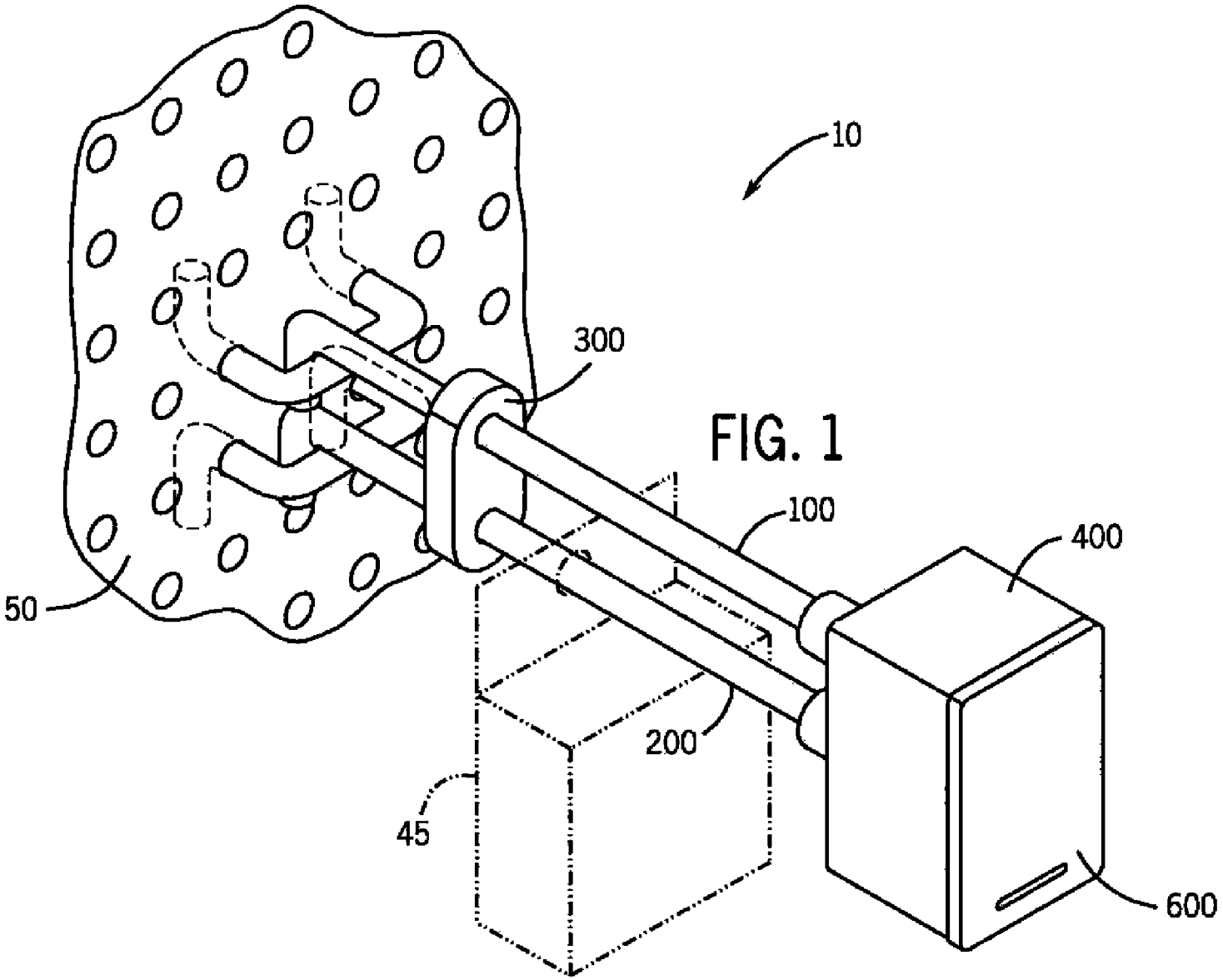
FIG. 1 is a perspective view of a theft deterrent system for apertured goods, in accordance with various embodiments of the present invention.
Figure 2:
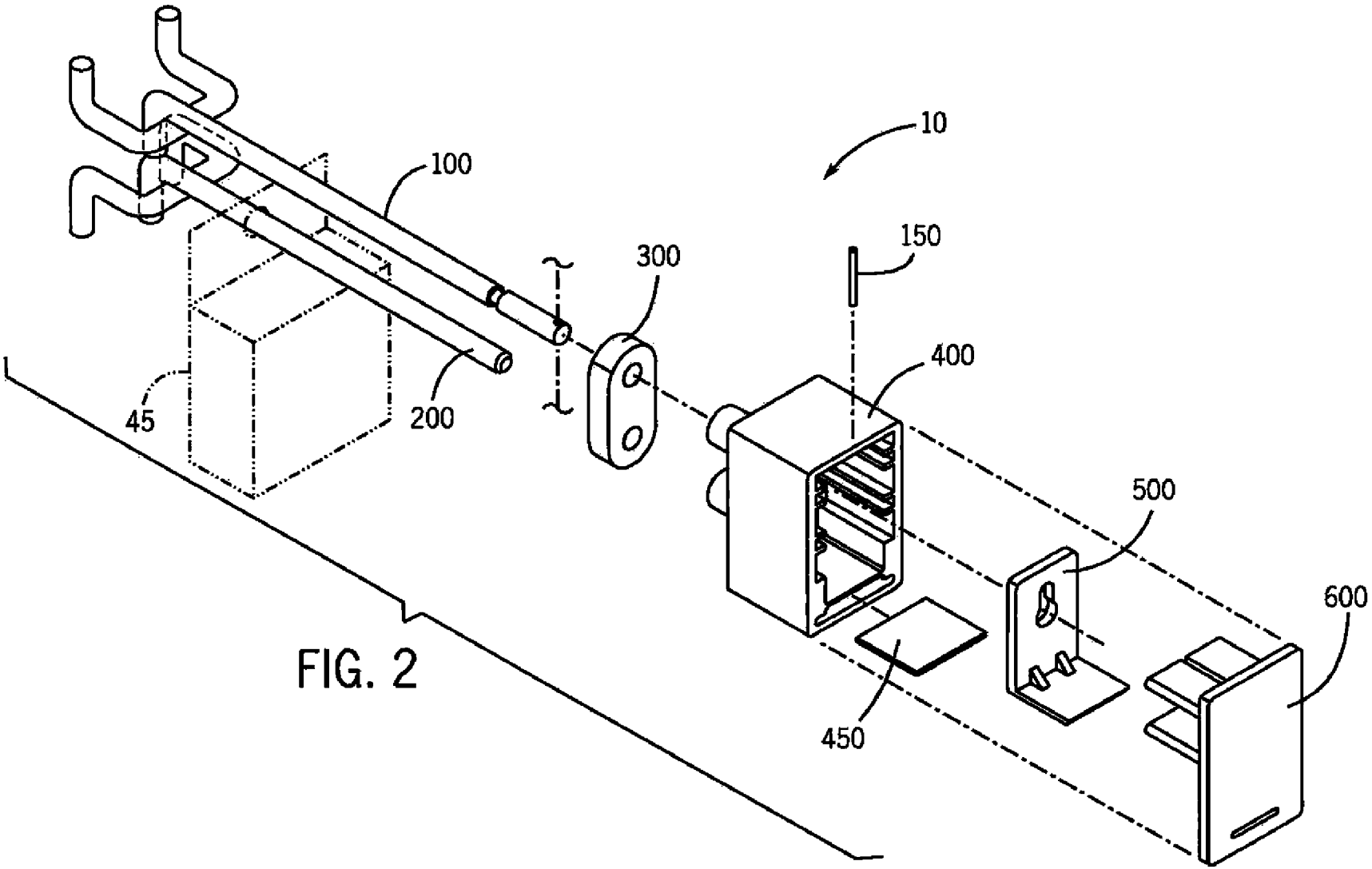
FIG. 2 is en exploded view of a theft deterrent system for apertured goods, in accordance with various embodiments of the present invention.

With reference to FIGS. 1 and 2, perspective and exploded views of a theft deterrent system 10 adapted to deter theft of a hanging, apertured article, in accordance with an embodiment, are respectively shown. The theft deterrent system 10 is adapted to be mounted to a display panel 50. In the illustrated embodiment of FIG. 1, the display panel 50 is a conventional pegboard. However, it is appreciated that display panel 50 may be any other kind of display panel known in the art, including but not limited to a slotted display panel or a wire grid display panel.

Generally speaking, the theft deterrent system 10 includes a locking apparatus 400 that cooperates with a number of elongate members that are attached to a display panel 50 in a cantilever orientation. In the illustrated embodiment, the locking apparatus 400 cooperates with an upper elongate member 100 and a lower at elongate member 200, wherein an apertured article is hung from the lower elongate member 200. In a locked configuration, depicted in FIG. 1, the locking apparatus 400 is fixed relative to the upper and lower elongate members 100 and 200, and an apertured article thus cannot be easily removed from the lower elongate member 200. In an unlocked configuration, the locking apparatus 400 may be slid forward relative to the elongate members 100 and 200, thereby creating space between the end of the lower at elongate member 200 and the locking apparatus 400, and thereby permitting easy removal of an apertured article from the lower elongate member 200.

Figure 3:
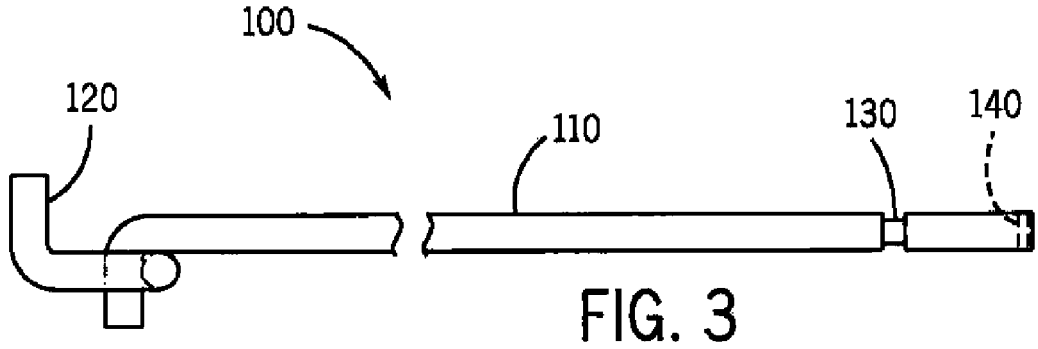
FIG. 3 is a side view of an upper support member of a theft deterrent system for apertured goods, in accordance with various embodiments of the present invention.
Figure 4:
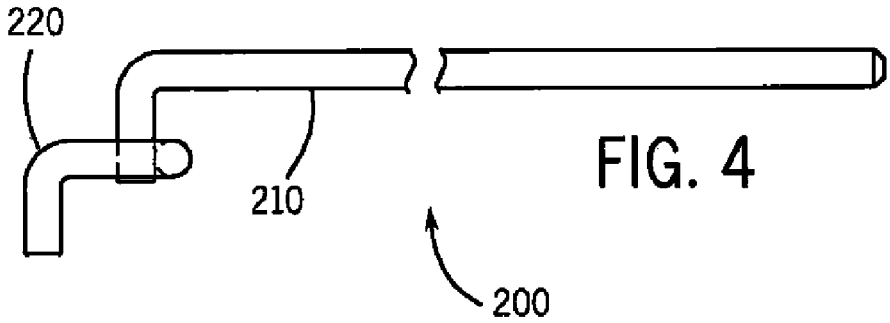
FIG. 4 is a side view of an lower support member of a theft deterrent system for apertured goods, in accordance with various embodiments of the present invention.
Figure 5A:
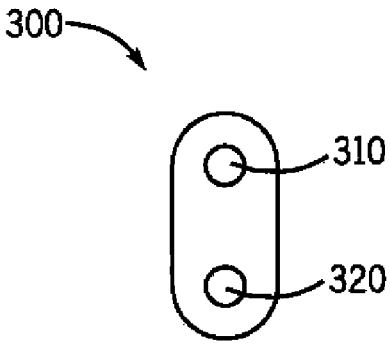
FIG. 5A is a front view of a support member stabilizer of a theft deterrent system for apertured goods, in accordance with various embodiments of the present invention.
Figure 5B:
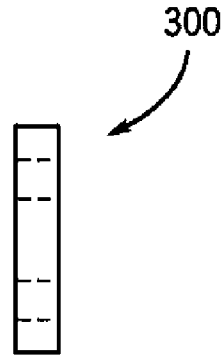
FIG. 5B is a side view of a support member stabilizer of a theft deterrent system for apertured goods, in accordance with various embodiments of the present invention.

In one embodiment, the elongate members 100 and 200 are configured to prevent a would-be shoplifter from simply removing the entire system 10 from the display panel 50, merchandise and all, and making off with the merchandise. As shown in FIGS. 1-3, the upper elongate member 100 includes an elongate portion 110 and an attachment portion 120. The attachment portion includes a plurality of hook-like members that extend outward and upward from the elongate portion 10. In a similar fashion, as shown in FIGS. 1, 2 and 4, the lower elongate member 200 includes an elongate portion 210 and an attachment portion 220, which likewise includes a plurality of hook-like members that extend outward and downward from the elongate portion 210.

Figure 6A:
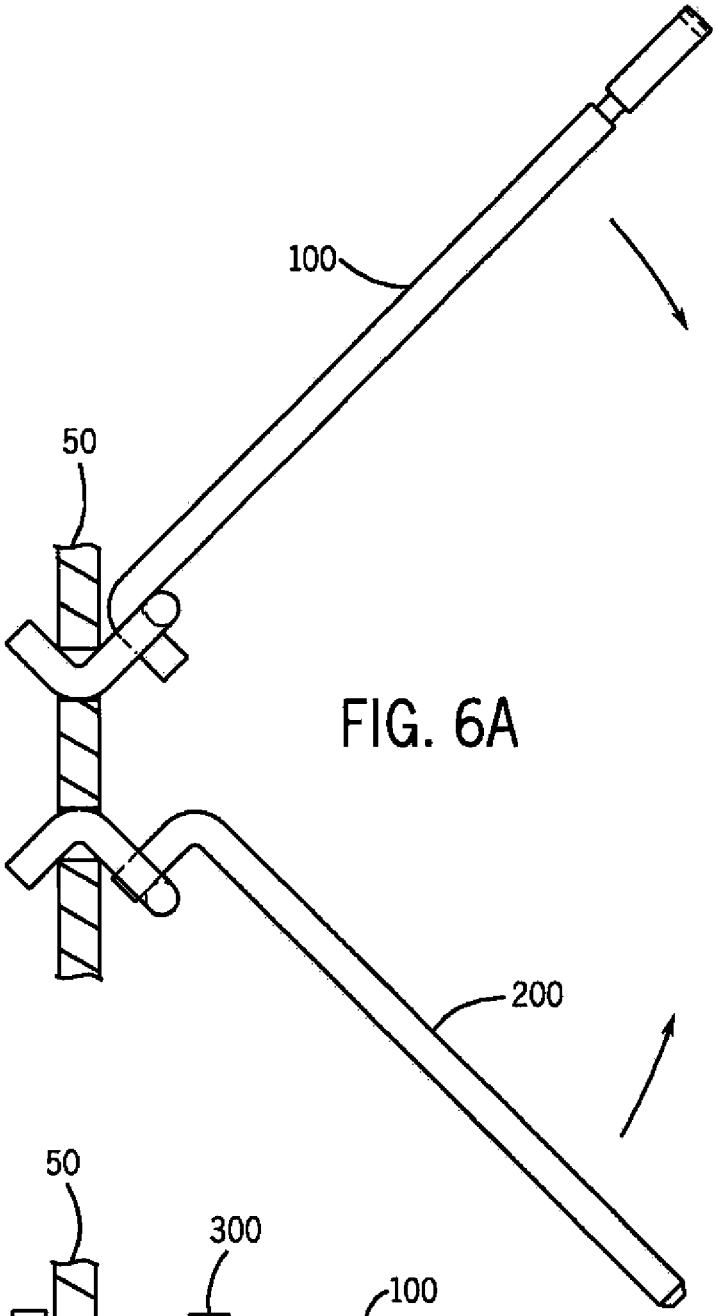
FIG. 6A illustrates an upper support member and a lower support member being inserted into a base, in accordance with various embodiments of the present invention.
Figure 6B:
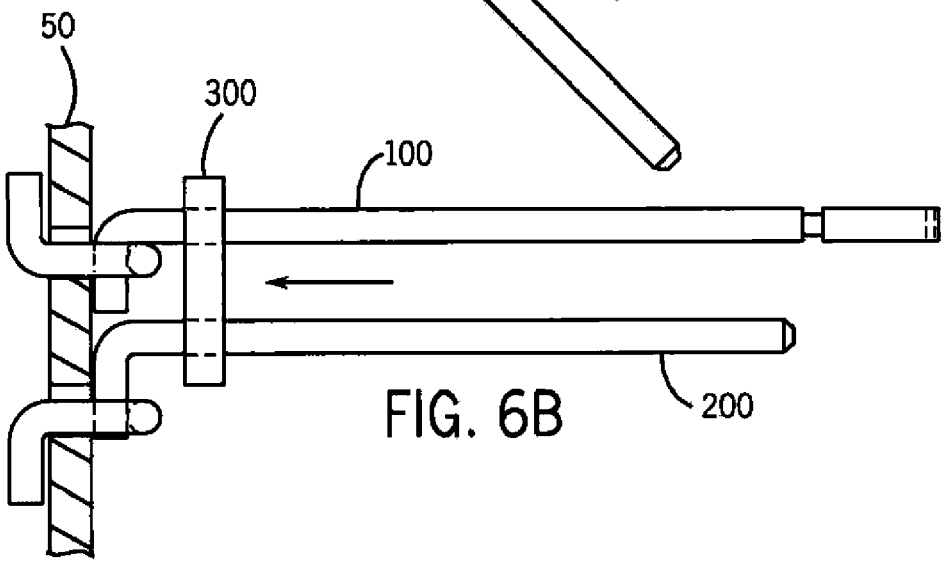
FIG. 6B illustrates an upper support member and a lower support member fully inserted into a base and held in place with support member stabilizer, in accordance with various embodiments of the present invention.

FIGS. 6A and 6B illustrate the upper elongate member 100 and lower elongate member 200 being installed onto the display panel 50. As shown in FIG. 6A, the upper elongate member 100 is installed onto the display panel 50 by inserting the hook-like members of the attachment portion 120 into respective holes in the pegboard 50 and pulling of the upper elongate member 100 downward into place. Conversely, the lower elongate member 200 is installed into the display panel 50 by inserting the hook-like members of its attachment portion 220 into respective holes in the pegboard 50 and pulling the lower elongate member 200 upward into place. The upper and lower elongate members 100 and 200 are then secured together using stabilizer 300. Once secured to each other with the stabilizer 300, each of the upper and lower elongate members 100 and 200 will "fight" the removal of the other from the display panel. For example, if a shoplifter tried to force the elongate members upward in an attempt to remove the upper elongate member 100, the lower elongate member 200 would resist such movement, and vise versa.

FIGS. 1, 2, 5A and 5B illustrate a stabilizer 300, in accordance with an embodiment of the present invention. Although a particular structure for stabilizer 300 is shown, it will be appreciated that other structures and configurations for securing the upper and lower elongate members 100 and 200 to each other are possible. In the illustrated embodiment, the stabilizer includes a main body having two apertures 310 and 320 that are sized and spaced so that the stabilizer 300 may be slid over the elongate portions 110 and 210 of the elongate members 100 and 200 after they have been attached to the display panel 50. Once in the upper and lower elongate members 100 and 200 and the stabilizer 300 are in place, the locking apparatus 400 may then be installed.

FIGS. 1, 2, 7A and 7B illustrate a locking apparatus 400, in accordance with an embodiment of the present invention. The locking apparatus 400 includes a housing that defines one or more internal chambers. In the illustrated embodiment, the housing includes a larger upper chamber 440 and a smaller lower chamber 430. The lower chamber 430 further includes a narrow upper portion 432 that is sized and shaped to accommodate a magnetic key 700 (discussed below), and a wide lower portion 434 that is sized and shaped to accommodate a magnetic shield 450.

Figure 7A:
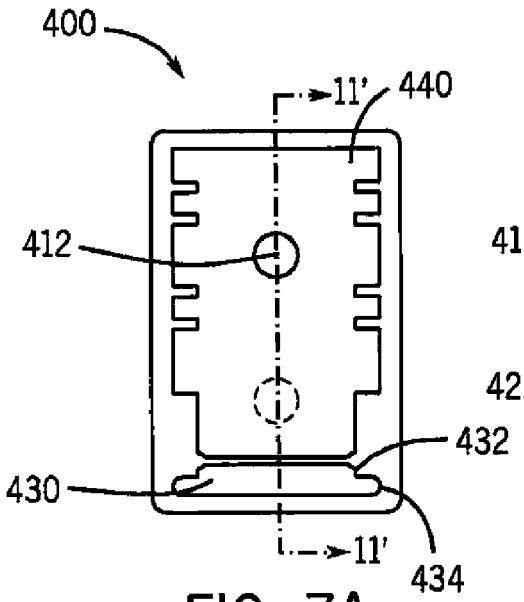
FIG. 7A is a front view of a lock box of a theft deterrent system, in accordance with various embodiments of the present invention.
Figure 7B:
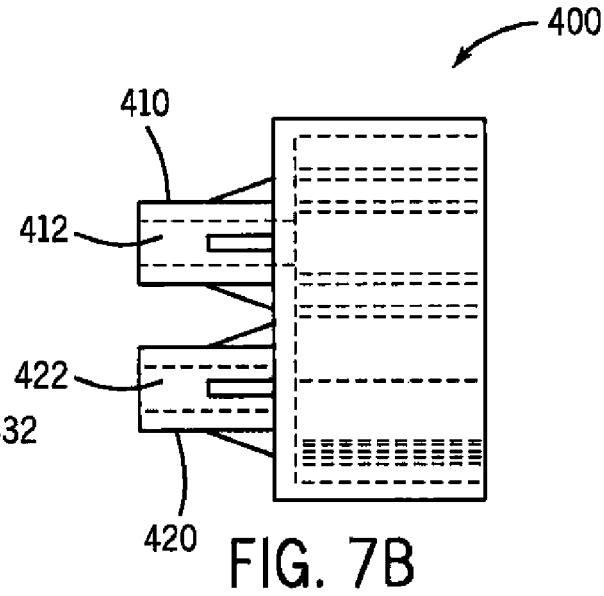
FIG. 7B is a side view of a lock box of a theft deterrent system, in accordance with various embodiments of the present invention.
Figure 8A:
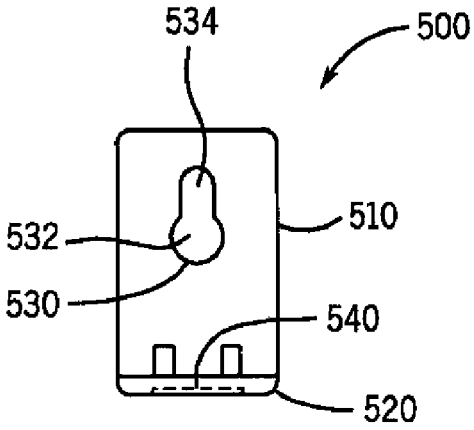
FIG. 8A is a front view of a lock member of a theft deterrent system, in accordance with various embodiments of the present invention.
Figure 8B:
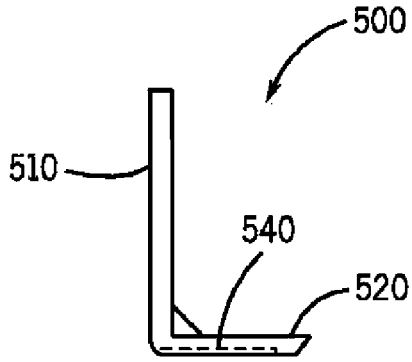
FIG. 8B is a side view of a lock member of a theft deterrent system, in accordance with various embodiments of the present invention.
Figure 8C:
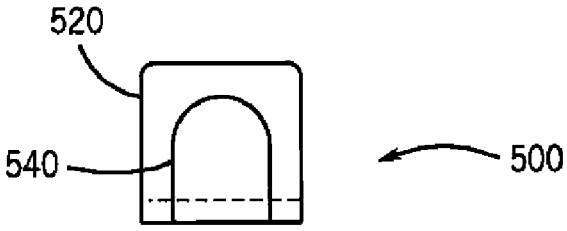
FIG. 8C is a bottom view of a lock member of a theft deterrent system, in accordance with various embodiments of the present invention.
Figure 9A:
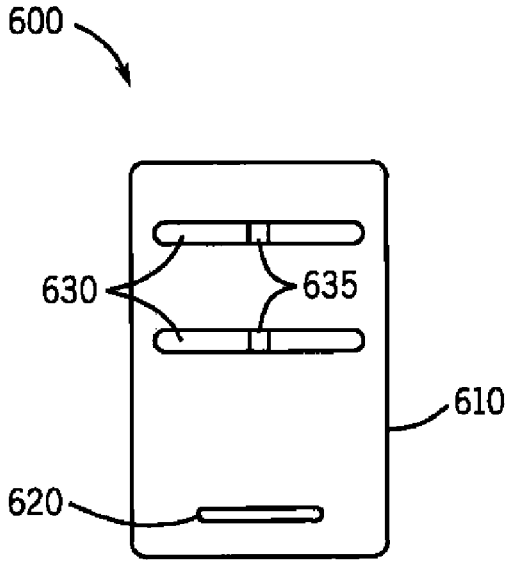
FIG. 9A is a rear view of a lock box faceplate of a theft deterrent system, in accordance with various embodiments of the present invention.
Figure 9B:
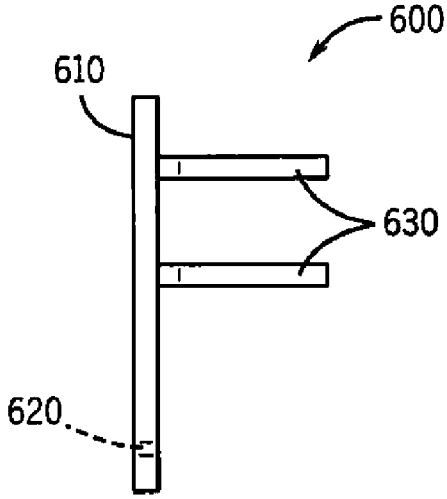
FIG. 9B is a side view of a lock box faceplate of a theft deterrent system, in accordance with various embodiments of the present invention.

As shown, the locking apparatus 400 includes upper and lower engagement members 410 and 420, each having corresponding apertures 412 and 422 therethrough. The engagement members 410 and 420 and the apertures 412 and 422 are sized and spaced to engage the upper and lower elongate members 100 and 200, respectively. Further, as shown in FIGS. 7A and 7B, aperture 412 of the upper engagement member 410 passes completely through the housing of locking apparatus 400 into the internal chamber 440, thereby allowing the upper elongate member 100 to pass into the internal chamber 440. Aperture 422 of the lower engagement member 420 may also pass through into the internal chamber 440, though it is not necessary in the illustrated embodiment.

The locking apparatus 400 also includes a locking member 500, which is movably positioned within the internal chamber 440. FIGS. 2, 8A, 8B and 8C illustrate the locking number 500, in accordance with an embodiment of the present invention. In the illustrated embodiment, the locking member 500 includes a vertical portion 510 and a horizontal portion 520. Significantly, the locking number 500 includes a magnetically responsive region 540 that is responsive to the magnetic key 700. The locking member 500 also includes an aperture 530. In the illustrated embodiment, the aperture 530 is "keyhole" shaped, having a wide portion 532 and a narrow portion 534. The wide portion 532 is sized and shaped to permit the upper elongate member 100 to freely pass therethrough in a longitudinal direction of the elongate member. The narrow portion 534 is sized to be narrower than a primary diameter of the upper elongate member 100, but wider than an undercut region 130 of the upper elongate member, to thereby serve as a catch for the upper elongate member 100. The cooperation of the locking member 500 with the upper elongate member 100 and the magnetic key 700 are discussed in further detail below.

As shown in FIGS. 1, 2, 9A and 9B, and the locking apparatus 400 may include a removable faceplate 600 that is coupleable to the housing of the locking apparatus 400. In the illustrated embodiment, the faceplate 600 includes an aperture 620 that is sized and shaped to accommodate the magnetic key 700 and that is substantially aligned with the upper portion 432 of the lower chamber 430 of the locking apparatus 400. The faceplate 600 may also include one or more projections 630 extending therefrom into the internal chamber 440, which aid in stabilizing the locking member 500 as it moves within the internal chamber 440.

Figure 10A:
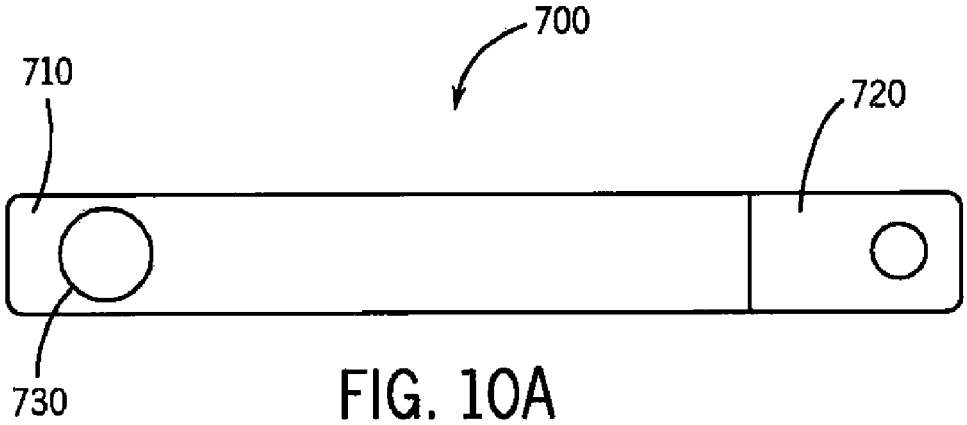
FIG. 10A is a top view of a magnetic key for a theft deterrent system, in accordance with various embodiments of the present invention.
Figure 10B:
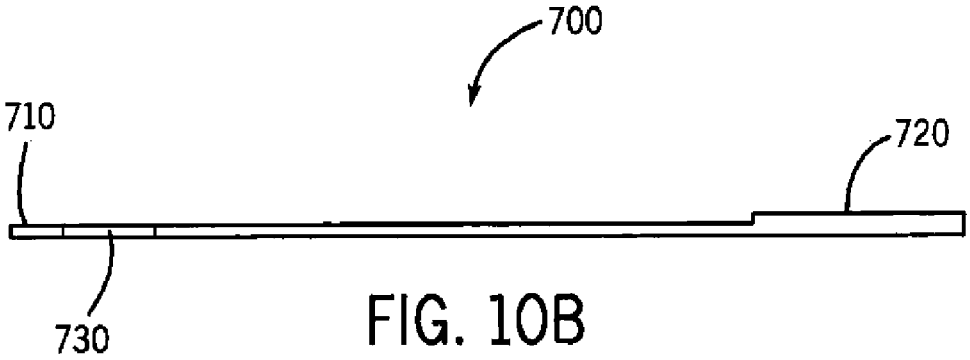
FIG. 10B is a side view of a magnetic key for a theft deterrent system, in accordance with various embodiments of the present invention.

FIGS. 10A and 10B illustrate a magnetic key 700 according to an embodiment. In the illustrated embodiment, the magnetic key 700 is generally flat and elongate, having a first and 710 end a second end 720. The magnetic key 700 also includes a magnetic region 730 disposed at or near the first end 710, wherein the magnetic region 730 of the key 700 is capable of interacting with the magnetic region 540 of the locking member 500 when the magnetic key is positioned within the upper region 432 of chamber 430.

During use/operation, the locking apparatus 400, by way of the locking member 500, is operable to selectively maintain the theft deterrent system 10 in locked and unlocked configurations. In the locked configuration, which corresponds to the magnetic key 700 not being positioned within chamber 432, the locking member 500 prevents the upper elongate member 100 from being withdrawn from aperture 412. In the unlocked configuration, which corresponds to the magnetic key 700 being inserted into chamber 432, the locking member 500 permits the upper elongate member 100 to be at least partially withdrawn from aperture 412.

Figure 11A:
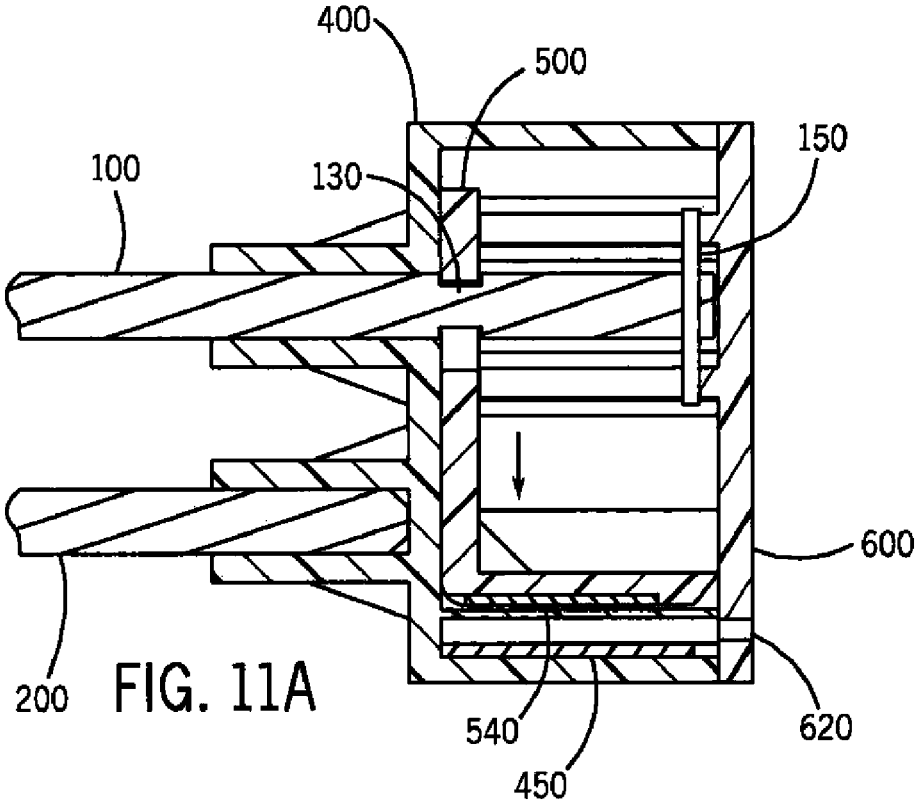
FIG. 11A is a cross-sectional view, taken along line 11' of FIG. 7A and looking in the direction of the arrows, of a theft deterrent system in a locked configuration, in accordance with various embodiments of the present invention.
Figure 11B:
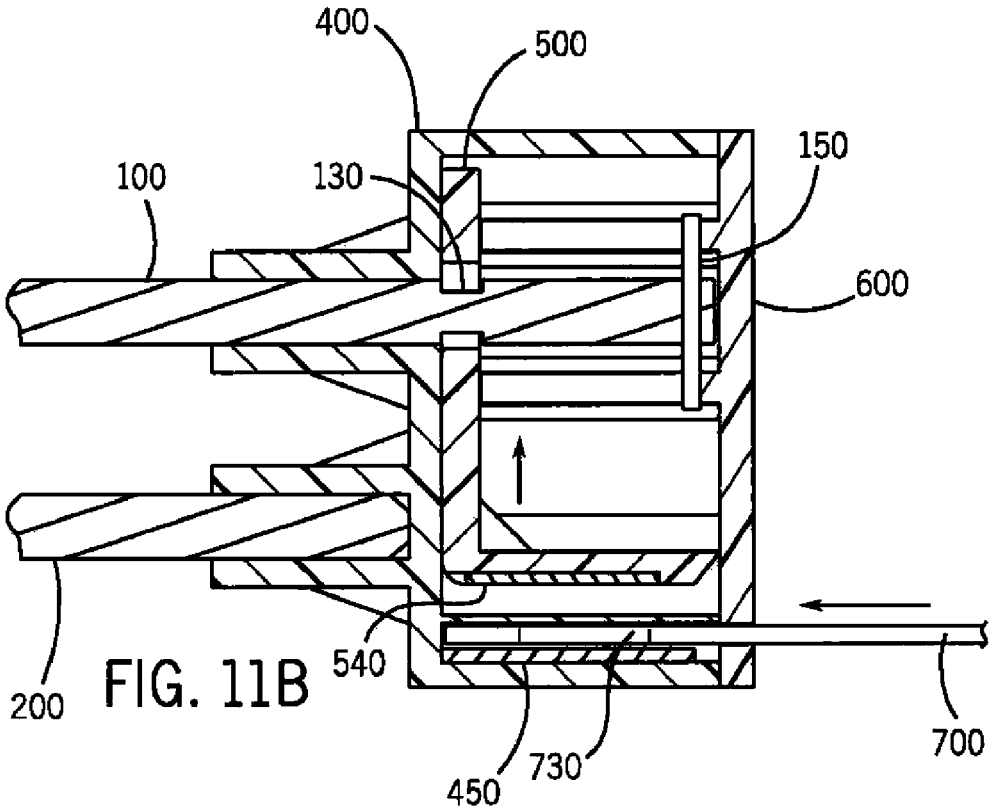
FIG. 11B is a cross-sectional view, taken along line 11' of FIG. 7A and looking in the direction of the arrows, of a theft deterrent system in an unlocked configuration, in accordance with various embodiments of the present invention.
Figure 12A:
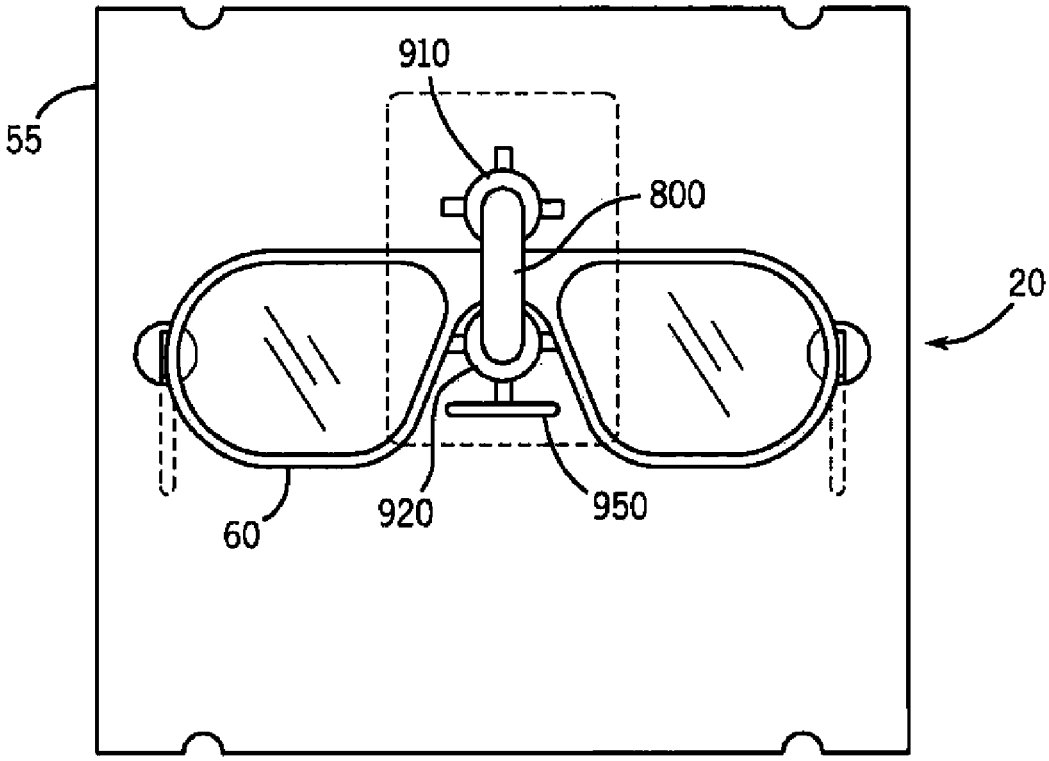
FIG. 12A is a front plan view of a theft deterrent system for eyeglasses, in accordance with various embodiments of the present invention.
Figure 12B:
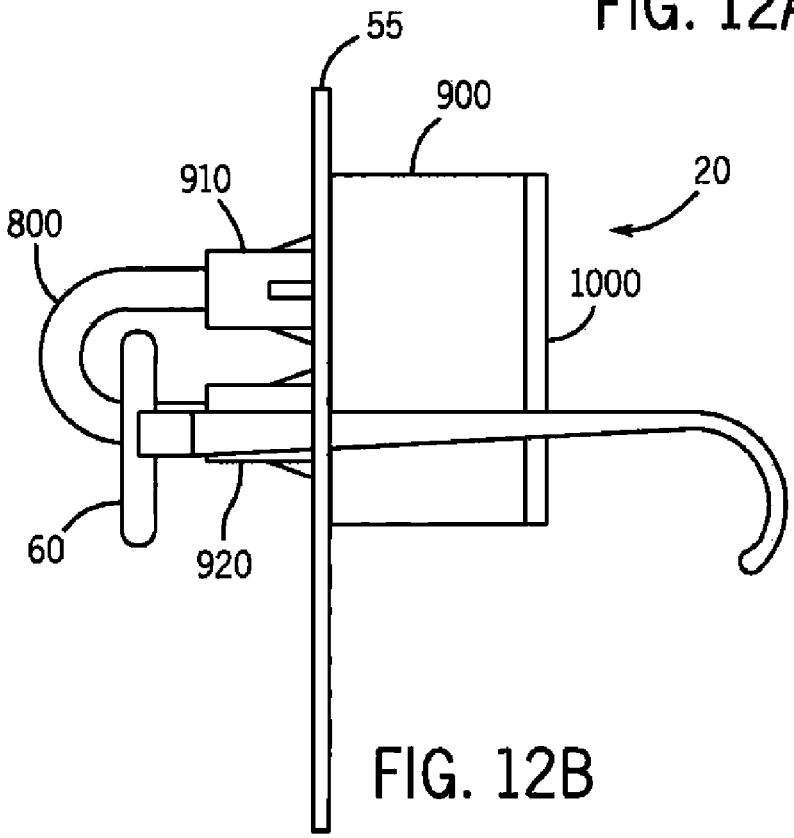
FIG. 12B is a side plan view of a theft deterrent system for eyeglasses, in accordance with various embodiments of the present invention.
Figure 12C:
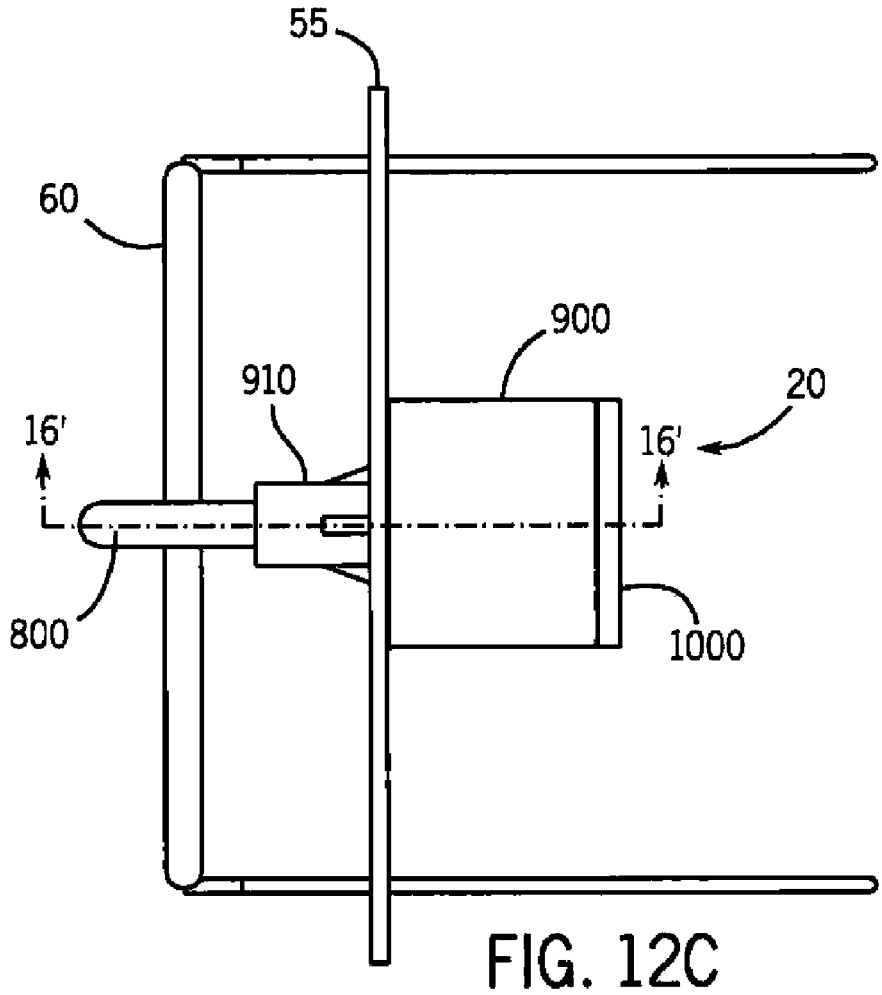
FIG. 12C is a top plan view of a theft deterrent system for eyeglasses, in accordance with various embodiments of the present invention.

FIGS. 11A and 11B show cross-sectional views of the theft deterrent system 10 in locked and unlocked configurations, respectively, and the switching therebetween, in accordance with an embodiment of the present invention. As shown in FIG. 11A, the locking member 500 is normally in a down position. When in the down position, the narrow portion 534 of the aperture 530 is generally coaxial with the upper elongate member 100. As a result, the locking member 500 engages a shoulder of the upper elongate member 100, which shoulder is formed by the undercut region 130. When the locking member 500 engages the upper elongate member 100, the upper elongate member 100 is not able to be withdrawn from the aperture 412. When in the locked configuration, the lower elongate member 200 is engaged by the lower engagement member 420 and is held in place by virtue of its fixed relationship with the upper elongate member 100.

As shown in FIG. 11B, the theft deterrent system 10 may be switched from the locked configuration to the unlocked configuration by inserting the magnetic key 700 through aperture 620 and into chamber 432. Once in the magnetic key 700 is inserted, the magnetic region 730 of the magnetic key 700 interacts with the magnetic region 540 of the locking member 500 and forces of the locking member 500 to move from a first position (e.g. down) to a second position (e.g. up) within the internal chamber 440. When in the up position, the wide portion 532 of the aperture 530 is generally coaxial with the upper elongate member 100. Since the wide portion 532 is at least as wide as the upper elongate member 100, the upper elongate member may therefore be at least partially withdrawn from aperture 412 when the locking member 500 is in the second position. When the upper elongate member is withdrawn from the internal chamber 440, the lower elongate member 200 is likewise withdrawn from engagement member 420, thereby creating separation between the operating end of the lower elongate member 200 and the lower engagement member 420 such that an apertured article may be removed from or added to the lower elongate member.

In one embodiment, once positioned within chamber 440, a pin 150 may be inserted through aperture 140 of the upper elongate member 100. Pin 150 serves to stabilize the upper elongate member 100 within the locking apparatus 400 and prevents the complete withdrawal of the upper elongate member 100 from the locking apparatus 400. In particular, the pin 150 is sized so that it abuts a face of the locking member or an internal face of the housing, thereby preventing complete withdrawal of the upper elongate member 100 from the locking apparatus 400. Additionally, the pin 150 may fit within the grooves 635 of protrusions 630 of the faceplate 600. Thus, rotation of the locking apparatus 400 about the upper elongate member 100 may also be prevented.

As mentioned earlier, the locking apparatus 400 may also include a magnetic shield 450 disposed within chamber 434, and thereby disposed between the outer surface of the housing and to the magnetic key 700, when inserted. By positioning the magnetic shield 450 as such, the magnetic shield can substantially prevent a magnetic force that is external to the housing, such as in the case where a shoplifter may attempt to unlock the locking apparatus 400 by pressing a handheld magnet up against the housing, from interacting with the locking member.

As discussed above, embodiments of the present invention are not limited solely to pegboard displays. Moreover, embodiments are also not limited to configurations in which rods are cantilevered from a display panel. For example, FIGS. 12A-16B illustrate another embodiment of a theft deterrent system 20 for deterring theft of eyeglasses 60 and other articles that are displayed in a similar manner. As shown, system 20 includes a locking apparatus 900, which is generally similar to locking apparatus 400 and is attached to a display panel 55. Although the illustrated embodiment shows the locking apparatus 900 being mounted to the rear-facing side of the display panel 55, it is appreciated that other arrangements are possible in which the locking apparatus 900 is mounted to a forward-facing side of the display panel. In one embodiment the locking apparatus 900 may be press-fit into the display panel 55.

Figure 13:
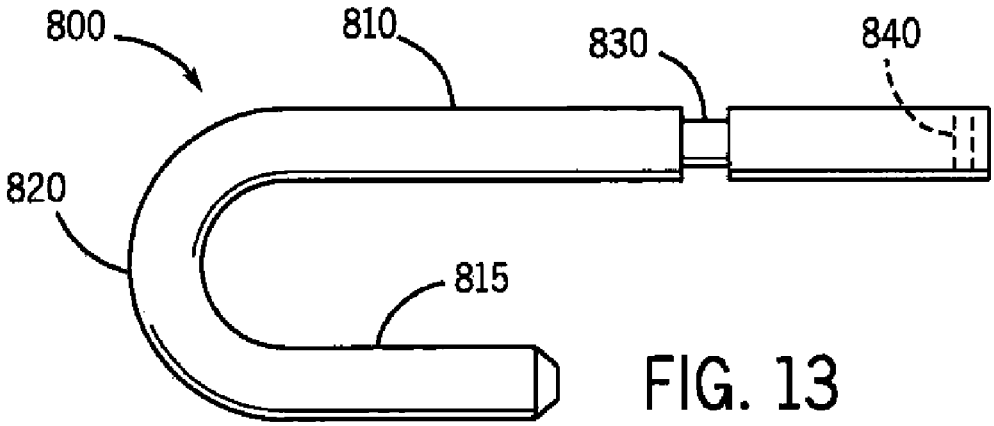
FIG. 13 is a side view of a curved support member of a theft deterrent system for eyeglasses, in accordance with various embodiments of the present invention.
Figure 14A:
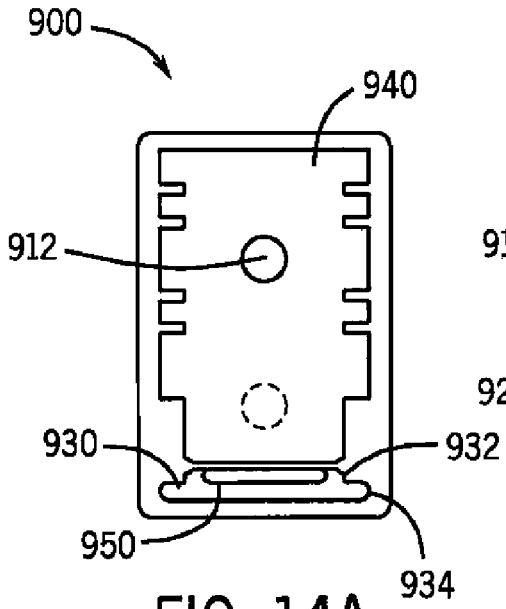
FIG. 14A is a front view of a lock box of a theft deterrent system, in accordance with various embodiments of the present invention.
Figure 14B:
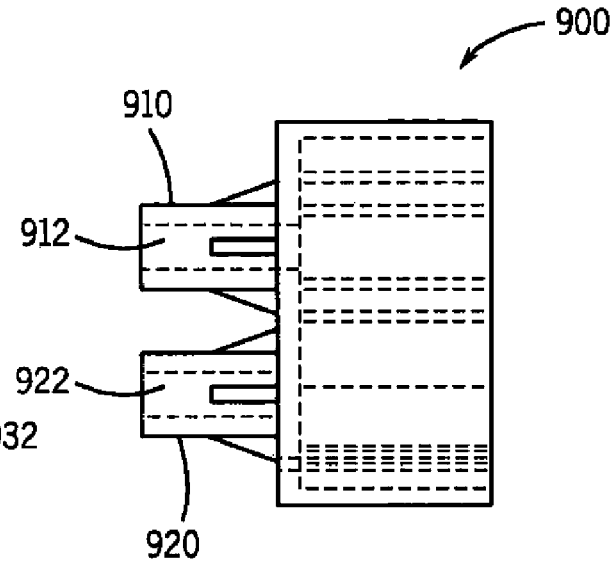
FIG. 14B is a side view of a lock box of a theft deterrent system, in accordance with various embodiments of the present invention.
Figure 15A:
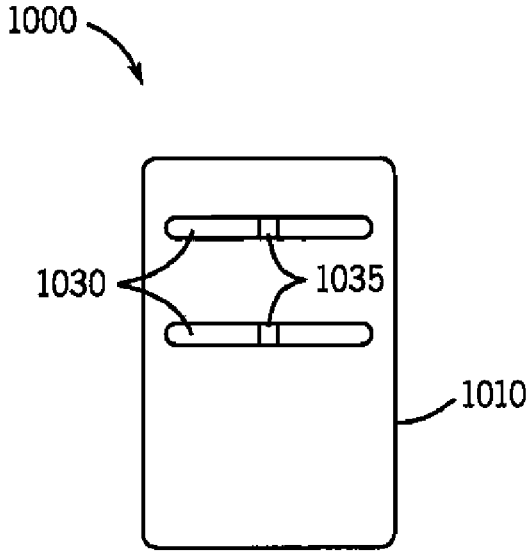
FIG. 15A is a rear view of a lock box faceplate of a theft deterrent system, in accordance with various embodiments of the present invention.
Figure 15B:
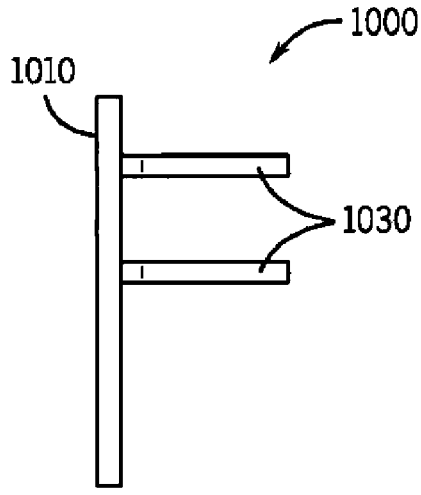
FIG. 15B is a side view of a lock box faceplate of a theft deterrent system, in accordance with various embodiments of the present invention.

In the illustrated embodiment, the eyeglasses 60 are secured to the locking apparatus 900 and the display panel 55 by securement portion 800. As shown in FIG. 13, the securement member 800 includes an upper elongate portion 810 and a lower elongate portion 815, which are connected to each other by a connecting portion 820. Similar to upper elongate member 100, the upper elongate portion 810 of the securement member 800 includes an undercut region 830 and an aperture 840 through which a pin 150 may be inserted.

The primary differences between the locking apparatus 900 and locking apparatus 400 are that locking apparatus 900 is mountable to a rear-facing side of a display panel and that the aperture 950 through which the magnetic key 700 is inserted is located on the opposite side of locking apparatus 900, such that the faceplate 1000 does not include an aperture. Otherwise, the locking apparatus 900 operates in much the same manner as locking apparatus 400. In particular, during use/operation, the locking apparatus 900, by way of the locking member 500, is similarly operable to selectively maintain the theft deterrent system 20 in locked and unlocked configurations. In the locked configuration, which corresponds to the magnetic key 700 not being positioned within chamber 932, the locking member 500 prevents the upper elongate portion 810 from being withdrawn from aperture 912. In the unlocked configuration, which corresponds to the magnetic key 700 being inserted into chamber 932, the locking member 500 permits the upper elongate portion 810 to be at least partially withdrawn from aperture 912.

Figure 16A:
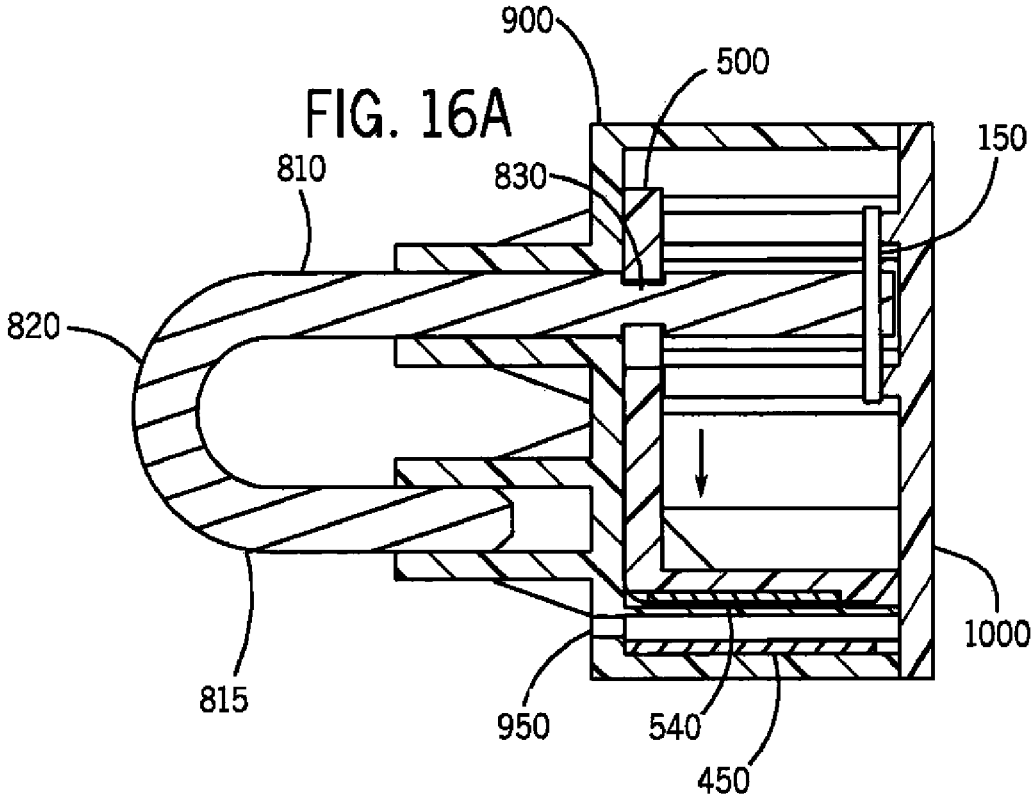
FIG. 16A is a cross-sectional view, taken along line 16' of FIG. 12C and looking in the direction of the arrows, of a theft deterrent system in a locked configuration, in accordance with various embodiments of the present invention.
Figure 16B:
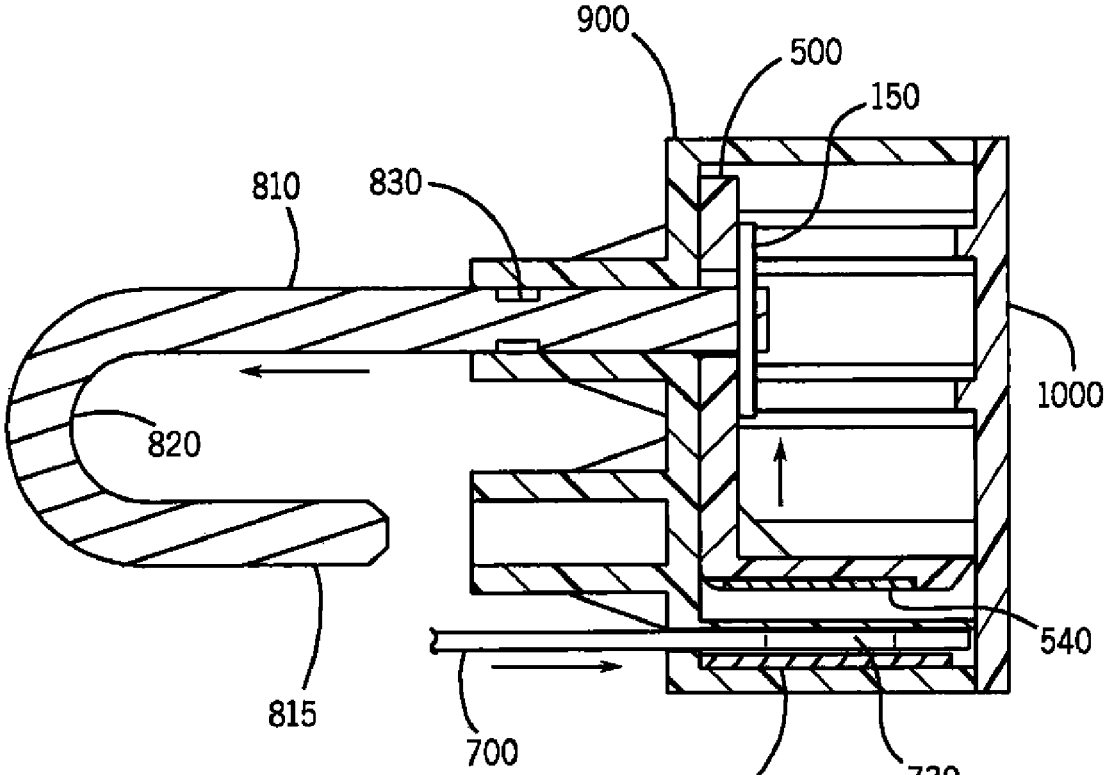
FIG. 16B is a cross-sectional view, taken along line 16' of FIG. 12C and looking in the direction of the arrows, of a theft deterrent system in an unlocked configuration, in accordance with various embodiments of the present invention.

FIGS. 16A and 16B show cross-sectional views of the left deterrent system 20 in locked and unlocked configurations, respectively, and the switching therebetween, in accordance with an embodiment of the present invention. As shown in FIG. 16A, when in the normally-down position, the narrow portion 534 of the aperture 530 is generally coaxial with the upper elongate portion 810. As a result, the locking member 500 engages a shoulder of the upper elongate portion 810, which shoulder is formed by the undercut region 830. When the locking member 500 engages the upper elongate member 810, the upper elongate portion 810 is not able to be withdrawn from the aperture 912. When in the locked configuration, the lower elongate portion 815 is engaged by the lower engagement member 920 and is held in place by virtue of its fixed relationship with the upper elongate portion 810 via the connecting portion 820.

As shown in FIG. 16B, the theft deterrent system 20 may be switched from the locked configuration to the unlocked configuration by inserting the magnetic key 700 through aperture 950 and into chamber 932. Once in the magnetic key 700 is inserted, the magnetic region 730 of the magnetic key 700 interacts with the magnetic region 540 of the locking member 500 and forces of the locking member 500 to move from a first position (e.g. down) to a second position (e.g. up) within the internal chamber 940. When in the up position, the wide portion 532 of the aperture 530 is generally coaxial with the upper elongate portion 810. Since the wide portion 532 is at least as wide as the upper elongate portion 810, the upper elongate member may therefore be at least partially withdrawn from aperture 912 when the locking member 500 is in the second position. When the upper elongate portion 810 is permitted to be withdrawn from the internal chamber 940, the lower elongate portion 815 is likewise withdrawn from lower engagement member 920, thereby creating separation between the end of the lower elongate portion 815 and the lower engagement member 920 such that the eyeglasses 60 may be removed from or added to the display.

Locking apparatus 900 may also include a magnetic shield 450 disposed within chamber 934, and disposed between the outer surface of the housing and the magnetic key 700, when inserted, for preventing a magnetic force that is external to the housing, such as in the case where a shoplifter may attempt to unlock the locking apparatus 400 by pressing a handheld magnet up against the housing, from interacting with the locking member.

Thus, embodiments provide secure systems for deterring the theft of displayed articles. The various components of embodiments may vary in size and shape depending on the application. Moreover, because of the simple magnetic key design, retailers can quickly and easily remove an article from the display for a customer. Thus, retailers are able to cut down on the amount of theft, thereby enabling them to maintain lower prices.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A theft deterrent apparatus for securing apertured articles to a forward-facing side of an article display panel, the theft deterrent apparatus comprising:

an elongate member affixed to the forward-facing side of the article display panel;

a housing disposed about and movable along said elongate member between a locked position and a release position, said housing defining an internal chamber; and a locking member movably disposed within the internal chamber to alternatively restrain the housing in its locked position along the elongate member, and release the housing for movement to its release position along the elongate member to, in turn, prevent and enable the removal of apertured articles from said article display panel, respectively;

said locking member including a magnetic actuator, which moves the locking member between the housing locked position along the elongate member and the housing release position along the elongate member, said magnetic actuator adapted to interact with a magnetic key for repelling said magnetic actuator from its housing locked position to its housing release position to, in turn, enable the longitudinal movement of said housing along the elongate member, to enable the removal of said apertured articles from said article display panel, said housing further comprising a key aperture adapted to receive the magnetic key, said magnetic key, upon positioning within said key aperture, serving to repel said magnetic actuator from its housing locked position to its housing release position, the removal of said magnetic key from said key aperture removing the repelling force between said magnetic key and said magnetic actuator, permitting the magnetic actuator to return to its housing locked position, without any biasing force other than gravity.

2. The theft deterrent apparatus as recited in claim 1, in which said housing further comprises a key aperture adapted to receive the magnetic key.

3. The theft deterrent apparatus as recited in claim 2, in which said magnetic key includes a magnetic portion and said magnetic actuator includes a magnetic element, wherein said key aperture is oriented such that, upon positioning the magnetic key within said key aperture, said magnetic portion of said magnetic key and said magnetic element of said magnetic actuator are juxtaposed to one another.

4. The theft deterrent apparatus as recited in claim 3, in which the planar surfaces of said magnetic portion of said magnetic key and said magnetic element of said magnetic actuator are matched in magnetic polarity.

5. The theft deterrent apparatus as recited in claim 4 in which the magnetic actuator of the locking member is repelled by the magnetic key when the magnetic key is positioned within the key aperture, thereby moving the locking member from the housing locked position to the housing release position.

6. The theft deterrent apparatus as recited in claim 5 in which the magnetic actuator causes the locking member to move from the housing release position to the housing locked position when the magnetic key is not in position within the key aperture.

7. The theft deterrent apparatus as recited in claim 1, in which the apertured articles are suspended upon the elongate member.

8. The theft deterrent apparatus as recited in claim 1, in which the locking member returns to its housing locked position in the absence of the magnetic key.

9. The theft deterrent apparatus as recited in claim 1, in which the internal chamber of said housing is securely sealed to prevent tampering therewith.

10. A theft deterrent system for securing apertured articles to a forward-facing side of an article display panel, the theft deterrent apparatus comprising:

an upper elongate member having an attachment end and an operating end, the attachment end being affixed to the forward-facing side of the article display panel;

a lower elongate member for supporting the apertured article, said lower elongate member having an attachment end and an operating end, the attachment end being affixed to the forward-facing side of the article display panel;

a magnetic key; and a locking apparatus for selectively securing the apertured articles to the lower elongate member, the locking apparatus comprising:

a housing disposed about and movable along said upper elongate member between a locked position and a release position, said housing defining an internal chamber, and said housing including:

a first aperture passing from an outer surface of the housing into the internal chamber, said first aperture adapted to receive the upper elongate member;

a second aperture passing from an outer surface of the housing into the internal chamber, said second aperture adapted to receive the lower elongate member; and a key aperture adapted to receive the magnetic key;

an upper engagement member encompassing the first aperture and extending outwardly from the housing, the upper engagement member adapted to engage the upper elongate member;

a lower engagement member encompassing the second aperture and extending outwardly from the housing, the lower engagement member adapted to engage the lower elongate member;

a locking member movably disposed within the internal chamber to alternatively restrain the locking apparatus in its locked position along the upper elongate member and release the locking apparatus for movement to its release position along the upper elongate member to, in turn, prevent and enable the removal of articles from said article display panel, respectively, said locking member including a magnetic actuator, which moves the locking member between a locking apparatus locked position along the upper elongate member and a locking apparatus release position along the upper elongate member, said magnetic actuator adapted to interact with the magnetic key for repelling said magnetic actuator from its locking apparatus locked position to its locking apparatus release position to, in turn, enable the longitudinal movement of said locking apparatus along the upper elongate member, to enable the removal of said apertured articles from the lower elongate member; and a magnetic shield disposed between the outer surface of the housing and the magnetic key when positioned within the key aperture, the magnetic shield substantially preventing a magnetic force that is external to the housing from interacting with the magnetic actuator.

11. The theft deterrent system as recited in claim 10 in which the magnetic actuator of the locking member is repelled by the magnetic key when the magnetic key is positioned within the key aperture, thereby causing the locking member to move from the locking apparatus locked position to the locking apparatus release position.

12. The theft deterrent system as recited in claim 11 in which the magnetic actuator causes the locking member to move from the locking apparatus release position to the locking apparatus locked position when the magnetic key is not positioned within the key aperture.

13. The theft deterrent system as recited in claim 11 in which insertion of the magnetic key into the key aperture creates a repellant magnetic force between the magnetic key and the magnetic actuator of the locking member that causes the locking member to move from the locking apparatus locked position to the locking apparatus release position.

14. The theft deterrent system as recited in claim 10 in which the upper elongate member comprises an elongate rod having an undercut, the undercut defining a shoulder on the upper elongate member, and wherein the locking member comprises a catch that cooperates with the shoulder of the upper elongate member to prevent longitudinal movement of the locking apparatus along the upper elongate member when the locking member is in the locking apparatus locked position.

15. The theft deterrent system as recited in claim 14 in which the catch disengages the shoulder of the upper elongate member to permit longitudinal movement of the locking apparatus along the upper elongate member when the locking member is in the locking apparatus release position.

16. The theft deterrent system as recited in claim 14, in which the locking member includes a aperture passing therethrough, the aperture having a wide portion and a narrow portion, the wide portion being sized and shaped to permit the upper elongate member to be inserted therethrough, and the narrow portion defining the catch.

17. The theft deterrent system as recited in claim 16 in which the presence of the magnetic key within the key aperture creates a repellant magnetic force between the magnetic key and the magnetic actuator of the locking member that causes the locking member to move from the locking apparatus locked position to the locking apparatus release position, wherein the narrow portion is substantially coaxial with the upper elongate member when the locking member is in the locking apparatus locked position and the wide portion is substantially coaxial with the upper elongate member when the locking member is in the locking apparatus release position.

18. The theft deterrent system as recited in claim 10 in which the attachment end of the upper elongate member includes a first hook-like member and the attachment end of the lower elongate member includes a second hook-like member, each of the hook-like members for facilitating attachment to the display panel, and wherein further the first and second hook-like members are oriented in substantially different directions with respect to each other when first attached to the display panel.

19. The theft deterrent system as recited in claim 18 in which the first and second hook-like members are oriented in substantially opposite directions with respect to each other when first attached to the display panel.

20. The theft deterrent system as recited in claim 18 further comprising:

a stabilizer for securing the upper and lower elongate members to each other after they have been first attached to the display panel.

21. The theft deterrent system as recited in claim 20 in which the stabilizer comprises a first aperture sized and shaped to accommodate the upper elongate member and a second aperture sized and shaped to accommodate the lower elongate member, wherein the stabilizer is slidably attached to the upper and lower elongate members by passing the upper and lower elongate members through the first and second apertures of the stabilizer.

22. The theft deterrent system as recited in claim 10 in which the upper elongate member includes a pin inserted radially through an aperture in the operating end of the upper elongate member, wherein the pin abuts a first internal surface of the locking apparatus to prevent complete removal of the locking apparatus from the upper elongate member when the housing is in the release position.

23. The theft deterrent system as recited in claim 22 in which the pin abuts a second internal surface of the locking apparatus to prevent rotation of the locking apparatus about the upper elongate member when the housing is in the release position.

24. A theft deterrent system for deterring theft of an apertured article and for attachment to a forward-facing side of a display panel, the theft deterrent system comprising:

an upper elongate member having an attachment end and an operating end, the attachment end attached to the forward-facing side of the display panel;

a lower elongate member for supporting the apertured article and having an attachment end and an operating end, the attachment end attached to the forward-facing side of the display panel, wherein the attachment end of the upper elongate member includes a first hook-like member and the attachment end of the lower elongate member includes a second hook-like member, each of the hook-like members for facilitating attachment to the display panel, and wherein further the first and second hook-like members are oriented in substantially different directions with respect to each other when attached to the display panel;

a magnetic key; and a locking apparatus for selectively securing the article to the lower elongate member, the locking apparatus comprising:

a housing defining an internal chamber, the housing including:

a first aperture passing from an outer surface of the housing into the internal chamber and adapted to receive the upper elongate member; and a second aperture adapted to receive the magnetic key;

an upper engagement member encompassing the first aperture and extending outwardly from the housing, the upper engagement member adapted to engage the upper elongate member;

a lower engagement member extending outwardly from the housing, the lower engagement member adapted to engage the lower elongate member;

a locking member having a magnetic actuator, said locking member being movably disposed within the internal chamber, the locking member adapted to selectively:

maintain the theft deterrent system in a locked configuration in which the locking member prevents longitudinal movement of the upper elongate member within the locking apparatus and the lower engagement member and the lower elongate member cooperate to prevent the article from being removed from the lower elongate member, and maintain the theft deterrent system in an unlocked configuration in which the locking member permits a degree of longitudinal movement of the upper elongate member within the locking apparatus such that the lower elongate member becomes disengaged from the lower engagement member to permit removal of the article from the lower elongate member;

a magnetic shield disposed between the outer surface of the housing and the magnetic key when inserted into the second aperture, the magnetic shield substantially preventing a magnetic force that is external to the housing from interacting with the locking member; and a stabilizer for securing the upper and lower elongate members to each other after they have been attached to the display panel, wherein neither of the upper and lower elongate members can be removed from the display panel when secured to the other by the stabilizer.

25. A theft deterrent apparatus for securing apertured articles to a forward-facing side of an article display panel, the theft deterrent apparatus comprising:

an elongate member affixed to the forward-facing side of the article display panel;

a housing disposed about and movable along said elongate member between a locked position and a release position, said housing defining an internal chamber;

a locking member movably disposed within the internal chamber to alternatively restrain the housing in its locked position along the elongate member, and release the housing for movement to its release position along the elongate member to, in turn, prevent and enable the removal of apertured articles from said article display panel, respectively;

said locking member including a magnetic actuator, which moves the locking member between the housing locked position along the elongate member and the housing release position along the elongate member, said magnetic actuator adapted to interact with a magnetic key for repelling said magnetic actuator from its housing locked position to its housing release position to, in turn, enable the longitudinal movement of said housing along the elongate member, to enable the removal of said apertured articles from said article display panel, said housing further comprising a key aperture adapted to receive the magnetic key, said magnetic key including a magnetic portion and said magnetic actuator including a magnetic element, wherein said key aperture is oriented such that, upon positioning the magnetic key within said key aperture, said magnetic portion of said magnetic key and said magnetic element of said magnetic actuator are juxtaposed to one another; and a magnetic shield disposed between the outer surface of the housing and the magnetic key when inserted in the key aperture, the magnetic shield substantially preventing a magnetic force that is external to the housing from interacting with the locking member.

26. The theft deterrent system as recited in claim 25 in which said magnetic shield comprises a metal plate.

27. A theft deterrent apparatus for securing apertured articles to a forward-facing side of an article display panel, the theft deterrent apparatus comprising:

an elongate member affixed to the forward-facing side of the article display panel;

a housing disposed about and movable along said elongate member between a locked position and a release position, said housing defining an internal chamber; and a locking member movably disposed within the internal chamber to alternatively restrain the housing in its locked position along the elongate member, and release the housing for movement to its release position along the elongate member to, in turn, prevent and enable the removal of apertured articles from said article display panel, respectively;

said locking member including a magnetic actuator, which moves the locking member between the housing locked position along the elongate member and the housing release position along the elongate member, said magnetic actuator adapted to interact with a magnetic key for repelling said magnetic actuator from its housing locked position to its housing release position to, in turn, enable the longitudinal movement of said housing along the elongate member, to enable the removal of said apertured articles from said article display panel, said housing further comprising a key aperture adapted to receive the magnetic key, said magnetic key including a magnetic portion and said magnetic actuator including a magnetic element, wherein said key aperture is oriented such that, upon positioning the magnetic key within said key aperture, said magnetic portion of said magnetic key and said magnetic element of said magnetic actuator are juxtaposed to one another, said locking member further comprising a catch that cooperates with a shoulder of the elongate member to prevent movement of the housing when the locking member is in the housing locked position, the shoulder of the elongate member being defined by an undercut in the elongate member.

28. The theft deterrent apparatus as recited in claim 27 in which the catch disengages the shoulder of the elongate member to permit movement of the housing when the locking member is in the housing release position.

29. The theft deterrent apparatus as recited in claim 27, in which the locking member includes a locking aperture passing therethrough, the locking aperture having a wide portion and a narrow portion, the wide portion being sized and shaped to permit the elongate member to be inserted therethrough, and the narrow portion defining the catch.

30. The theft deterrent apparatus as recited in claim 29 in which the presence of the magnetic key within the key aperture creates a repellant magnetic force between the magnetic key and the magnetic actuator of the locking member that causes the locking member to move from the housing locked position to the housing release position, wherein the narrow portion of the locking aperture is substantially coaxial with the elongate member when the locking member is in the housing locked position and the wide portion of the locking aperture is substantially coaxial with the elongate member when the locking member is in the housing release position.

31. A theft deterrent apparatus for securing apertured articles to a forward-facing side of an article display panel, the theft deterrent apparatus comprising:

an elongate member affixed to the forward-facing side of the article display panel;

a housing disposed about and movable along said elongate member between a locked position and a release position, said housing defining an internal chamber; and a locking member movably disposed within the internal chamber to alternatively restrain the housing in its locked position along the elongate member, and release the housing for movement to its release position along the elongate member to, in turn, prevent and enable the removal of apertured articles from said article display panel, respectively;

said locking member including a magnetic actuator, which moves the locking member between the housing locked position along the elongate member and the housing release position along the elongate member, said magnetic actuator adapted to interact with a magnetic key for repelling said magnetic actuator from, its housing locked position to its housing release position to, in turn, enable the longitudinal movement of said housing along the elongate member, to enable the removal of said apertured articles from said article display panel, said elongate member being a first elongate member;

a second elongate member attached to and extending from the forward-facing side of the display panel, said apertured articles being suspended from the second elongate member;

a first engagement member extending outwardly from the housing, the first engagement member adapted to engage the first elongate member;

a second engagement member extending outwardly from the housing, the second engagement member adapted to engage the second elongate member, wherein the second engagement member and the second elongate member cooperate to prevent an article from being removed from the second elongate member when the housing is in the locked position, and wherein the second elongate member becomes disengaged from the second engagement member to permit the removal of the article from the second elongate member when the housing is in the release position.

* * * * *